United States Patent [19]

Kinugasa

[11] Patent Number: 4,667,631

[45] Date of Patent: May 26, 1987

[54] METHOD AND APPARATUS FOR CONTROLLING AIR-FUEL RATIO IN INTERNAL COMBUSTION ENGINE

[75] Inventor: Yukio Kinugasa, Susono, Japan

[73] Assignee: Toyota Jidosha Kabushiki Kaisha, Aichi, Japan

[21] Appl. No.: 794,661

[22] Filed: Nov. 4, 1985

[30] Foreign Application Priority Data

Nov. 5, 1984 [JP] Japan ..... 59-232862

[51] Int. Cl.[4] ..... F02M 51/00

[52] U.S. Cl. ..... 123/325; 123/492; 364/431.07

[58] Field of Search ..... 123/325, 326, 489, 492, 123/493; 364/431.05, 431.07, 431.09

[56] References Cited

U.S. PATENT DOCUMENTS

| | | | |
|---|---|---|---|
| 4,414,941 | 11/1983 | Nakanishi | 123/325 X |
| 4,484,497 | 11/1984 | Hibino | 123/325 X |
| 4,499,882 | 2/1985 | Saito et al. | 123/492 |
| 4,512,321 | 4/1985 | Yamato | 123/326 X |
| 4,523,571 | 6/1985 | Yamato et al. | 123/493 X |
| 4,535,744 | 8/1985 | Matsumura | 123/325 X |

*Primary Examiner*—Willis R. Wolfe, Jr.
*Attorney, Agent, or Firm*—Kenyon & Kenyon

[57] ABSTRACT

In an internal combustion engine, a base fuel amount is calculated, and a synchronous fuel amount to be supplied to the engine is calculated in accordance with the base fuel amount. Further, an air-fuel ratio deviation is calculated when the engine is in an acceleration state, and an asynchronous fuel amount is calculated for the transition of the engine from a fuel cut-off state to a fuel cut-off recovery state in accordance with the calculated air-fuel ratio deviation.

12 Claims, 13 Drawing Figures

METHOD AND APPARATUS FOR CONTROLLING AIR-FUEL RATIO IN INTERNAL COMBUSTION ENGINE

BACKGROUND OF THE INVENTION

1. Field of the Invention

The present invention relates to a method and apparatus for feedback control of the air-fuel ratio in an internal combustion engine.

2. Description of the Related Art

Generally, in a feedback control of the air-fuel ratio, a base fuel amount TAUP is calculated in accordance with the detected intake air amount and the detected engine speed, and the base fuel amount TAUP is corrected by an air-fuel ratio correction coefficient FAF which is calculated in accordance with the output signal of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very small range of air-fuel ratios around the stoichiometric ratio required for three way reducing and oxidizing catalysts which can remove three pollutants CO, HC, and $NO_x$ simultaneously from the exhaust gas.

In the above-mentioned type of apparatus, however, no consideration is given to long-term changes in the operating characteristics of the engine, for example, changes in characteristics due to deposition of a viscous material such as fine carbon particles originating from lubricant constituents and combustion products at the valve clearance or at an injection nozzle of an electronic fuel injector and changes in characteristics due to such deposition at the rear surface of each cylinder intake valve. In addition, the above-mentioned apparatus has no means for detecting a change of the air-fuel ratio during a transient state such as an acceleration mode or a deceleration mode deviated from the optimum value due to the long-term changes in the operating characteristics of the engine, changes in the gasoline characteristics, or the like. Therefore, if gasoline having low volatility characteristics is used, or if long term changes occur in the engine, the air-fuel ratio becomes lean during an acceleration mode, thereby leading to bad drivability such as non-smooth acceleration. Contrary to this, if gasoline having high volatility characteristics is used, the air-fuel ratio becomes rich during a deceleration mode, thereby increasing the fuel consumption and deteriorating the emission gas characteristics.

Thus, when engine operation characteristics change due to long-term deposits or when low volatility gasoline is used, the air-fuel ratio in an acceleration state becomes relatively lean. Hence, the engine operation deteriorates, e.g., non-smooth acceleration occurs. On the other hand, the air-fuel ratio in a deceleration state becomes relatively rich. Hence, emission and the specific fuel consumption deteriorate. Even when a high volatility gasoline is used, the air-fuel ratio becomes rich in an acceleration state, resulting in the same problems.

A technique for the control of the air-fuel ratio to overcome the above problems has been proposed in U.S. Pat. No. 4,499,882. According to this technique, the air-fuel ratio deviation from a reference air-fuel ratio is detected during an acceleration period of the engine, and the correction amount for transient fuel injection amount correction is calculated in accordance with the detected air-fuel ratio deviation, thereby avoiding the deviation of the air-fuel ratio from the optimum value due to the deposition of viscous material on the rear surface of each cylinder intake valve, and the like, during an acceleration mode, and thus the drivability, the fuel consumption, and the gas emission are improved.

Note that the air-fuel ratio deviation has a relation to the amount of the deposition of viscous material on the rear surface of each cylinder intake valve, which will be later explained.

In the above-mentioned technique, however, in the case of a large amount of deposition of viscous material on the rear surface of each cylinder valve, when a fuel cut-off operation continues for a definite time period, fuel absorbed in the deposition is evaporated and is injected into the combustion chambers. As a result, when a fuel cut-off recovery operation is again carried out, fuel injected from the fuel injection valves is first absorbed by the deposits, thereby reducing the engine speed, thus inviting a rough idling phenomenon, engine stalling, or the like.

Note that fuel cut-off control is effected to stop the injection of fuel during deceleration, thereby improving fuel consumption. The control of the fuel cut-off depends upon the opening of a throttle valve, the engine speed, and the like. For example, when the throttle valve is completely closed and the engine speed is higher than a predetermined fuel cut-off engine speed, fuel cut-off is activated. Contrary to this, when the throttle valve is not completely closed or when the engine speed is lower than a predetermined fuel cut-off recovery engine speed, fuel cut-off is released. In this case, the fuel cut-off engine speed is higher than the fuel cut-off recovery engine speed, thereby obtaining the hysteresis characteristics of the engine speed. In addition, both the fuel cut-off engine speed and the fuel cut-off recovery engine speed are dependent upon engine state parameters such as the coolant temperature of the engine.

SUMMARY OF THE INVENTION

It is an object of the present invention to provide a method and apparatus for controlling the air-fuel ratio in an internal combustion engine which can smooth the change of the engine speed at the transition from a fuel cut-off state to a fuel cut-off recovery state, even when the amount of deposits on the rear surface of each cylinder valve is large.

According to the present invention, an asynchronous fuel amount is calculated in accordance with the air-fuel ratio deviation, i.e., the amount of the deposits. That is, when the amount of the deposition is large, the calculated asynchronous fuel amount is large. Fuel corresponding to this calculated asynchronous fuel amount is injected at the transition from a fuel cut-off state to a fuel cut-off recovery state, thereby compensating the amount of fuel to be absorbed by the deposits.

BRIEF DESCRIPTION OF THE DRAWINGS

The present invention will be more clearly understood from the description as set forth below with reference to the accompanying drawings, wherein:

FIGS. 6, 7, 7A, 7B, 8, 9, 10 and 11 are flowcharts of the operation of the control circuit of FIG. 1.

DESCRIPTION OF THE PREFERRED EMBODIMENTS

Figure 1:
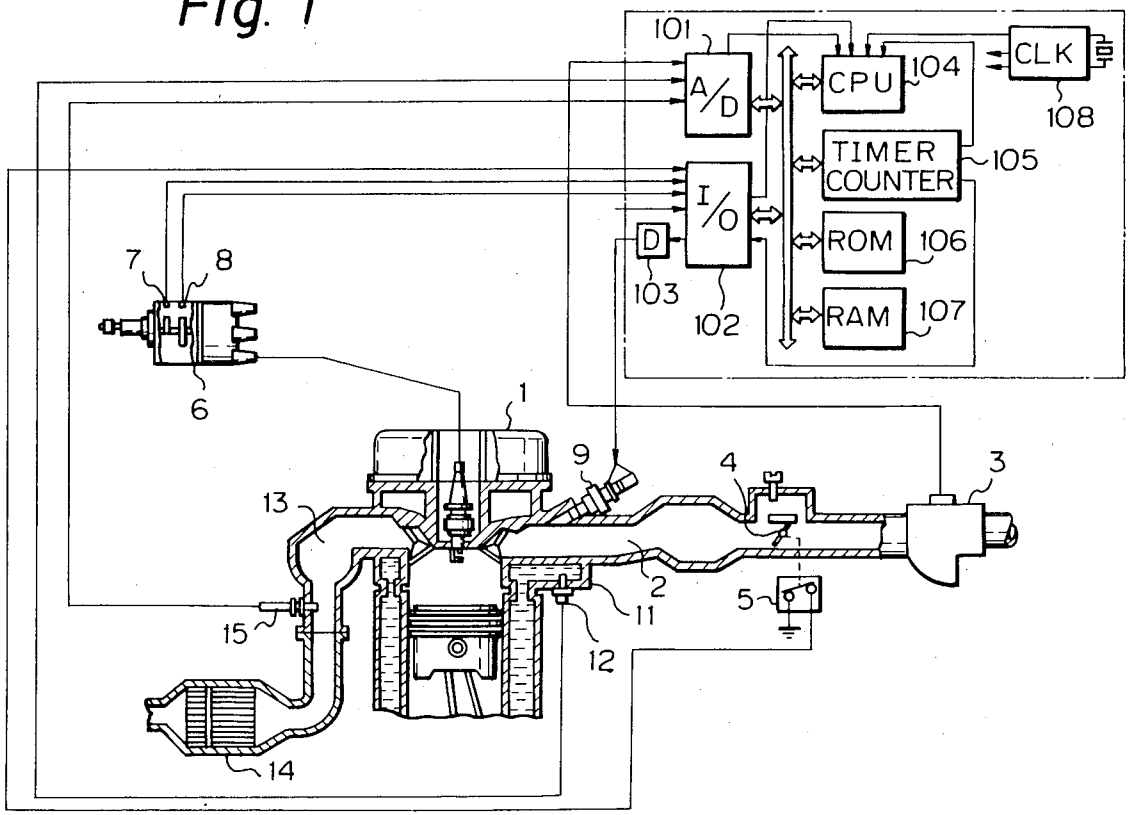
FIG. 1 is a schematic view of an internal combustion engine according to the present invention.

In FIG. 1, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Also provided in the air-intake passage 2 is a throttle valve 4 which has an idling position switch 5 at the shaft thereof. The idling position switch 5 detects whether or not the throttle valve 4 is completely closed, i.e., in an idling position, to generate an idle signal "LL" which is transmitted to an input/output (I/O) interface 102.

Disposed in a distributor 6 are crank angle sensors 7 and 8 for detecting the angle of the crankshaft (not shown) of the engine 1. In this case, the crank-angle sensor 7 generates a pulse signal at every 720° crank angle (CA) while the crank-angle sensor 8 generates a pulse signal at every 30° CA. The pulse signals of the crank angle sensors 7 and 8 are supplied to the I/O interface 102 of the control circuit 10. In addition, the pulse signal of the crank angle sensor 8 is then supplied to an interruption terminal of a central processing unit (CPU) 104.

Additionally provided in the air-intake passage 2 is a fuel injection valve 9 for supplying pressurized fuel from the fuel system to the air-intake port of the cylinder of the engine 1. In this case, other fuel injection valves are also provided for other cylinders, though not shown in FIG. 1.

Disposed in a cylinder block 11 of the engine 1 is a coolant temperature sensor 12 for detecting the temperature of the coolant. The coolant temperature sensor 12 generates an analog voltage signal in response to the temperature of the coolant and transmits it to the A/D converter 101 of the control circuit 10.

Provided in an exhaust gas passage 13 of the engine 1 is a three-way reducing and oxidizing catalyst converter 14 which removes three pollutants CO, HC, and $NO_x$ simultaneously in the exhaust gas. Also provided upstream of the three way converter 14 is an $O_2$ sensor 15 for detecting the concentration of oxygen composition in the exhaust gas. The $O_2$ sensor 15 generates an output voltage signal and transmits it to the A/D converter 101 of the control circuit 10.

The control circuit 10, which may be constituted by a microcomputer, includes a driver circuit 103 for driving the fuel injection valve 9, a timer counter 105, a read-only memory (ROM) 106 for storing a main routine, interrupt routines such as a fuel injection routine, an ignition timing routine, tables (maps), constants, etc., a random access memory (RAM) 107 for storing temporary data, a clock generator 108 for generating various clock signals, and the like, in addition to the A/D converter 101, the I/O interface 102, and the CPU 104.

The timer counter 105 may include a free-run counter, a compare register, a comparator for comparing the content of the free-run counter with that of the compare register, flag registers for compare interruption, injection control, and the like. Of course, the timer counter 105 also may include a plurality of compare registers and a plurality of comparators. In this case, the timer counter 105 is used for controlling the injection start and end operation.

Interruptions occur at the CPU 104, when the A/D converter 101 completes an A/D conversion and generates an interrupt signal; when the crank angle sensor 8 generates a pulse signal; when the timer counter 105 generates a compare interrupt signal; and when the clock generator 108 generates a special clock signal.

The intake air amount data Q of the airflow meter 3 and the coolant temperature data THW of the coolant temperature sensor 12 are fetched by an A/D conversion routine executed at every predetermined time period and is then stored in the RAM 107. That is, the data Q and THW in the RAM 107 are renewed at every predetermined time period. The engine rotational speed $N_e$ is calculated by an interrupt routine executed at 30° CA, i.e., at every pulse signal of the crank angle sensor 8, and is then stored in the RAM 108.

Figure 2:
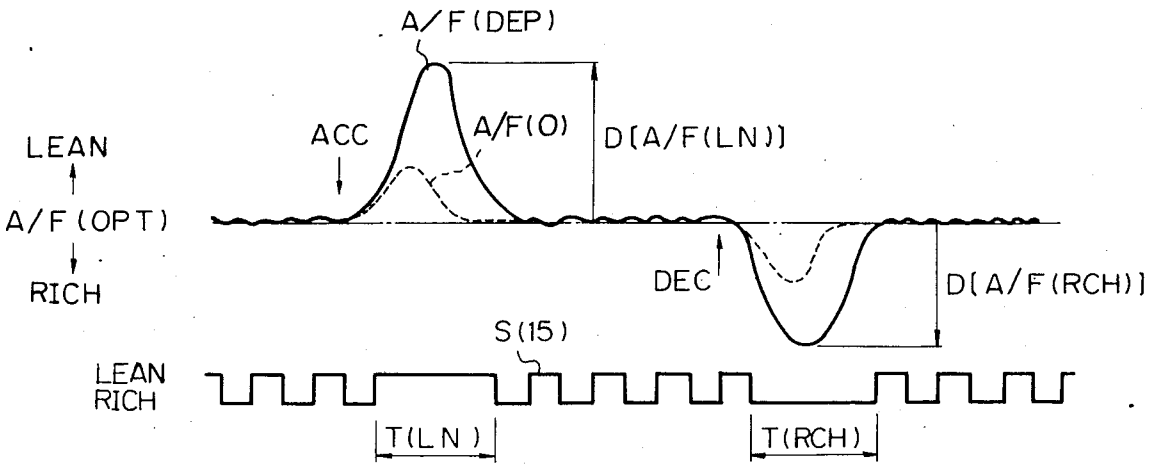
FIG. 2 is a waveform diagram illustrating the relationship between the air-fuel ratio and the output signal of the air-fuel ratio sensor during a transient state.

Next, the manner of the change with time of the air-fuel ratio in an internal combustion engine under the influence of deposits will be explained with reference to FIGS. 2 and 3. In FIG. 2, the waveform A/F(O) represents the change of the air-fuel ratio without deposits, while the waveform A/F(DEP) represents the change of air-fuel ratio with deposits. Acceleration timing ACC, deceleration timing DEC, optimum air-fuel ratio A/F(OPT), and an output signal S(15) of the $O_2$ sensor 15 are indicated in FIG. 2.

Figure 3:
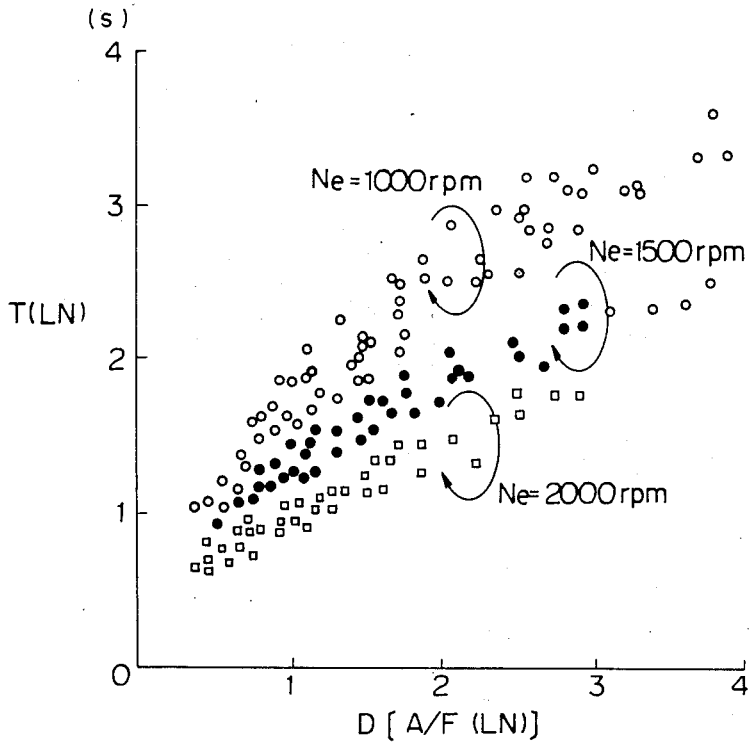
FIG. 3 is a diagram illustrating the relationship between the air-fuel ratio deviation and the duration of the lean state during a transient state.

The relationship between the maximum deviation D[A/F(LN)]to the lean side from the optimum air-fuel ratio A/F(OPT) state and the time length or duration T(LN) of detecting the lean (LN) rich (RCH) state of the mixed gas by the air-fuel ratio in the acceleration state is illustrated in FIG. 3. It will be understood from FIG. 3 that the maximum deviation D[A/F(LN)]has an approximately linear relationship to the duration T(LN), and its slope is dependent upon the engine speed $N_e$.

Figure 4:
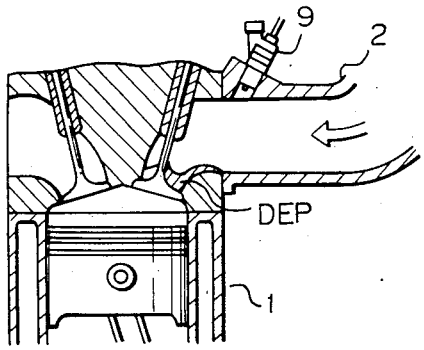
FIG. 4 is a cross-sectional view of the engine of FIG. 1 explaining the existence of deposits in the air-intake passage.
Figure 5:
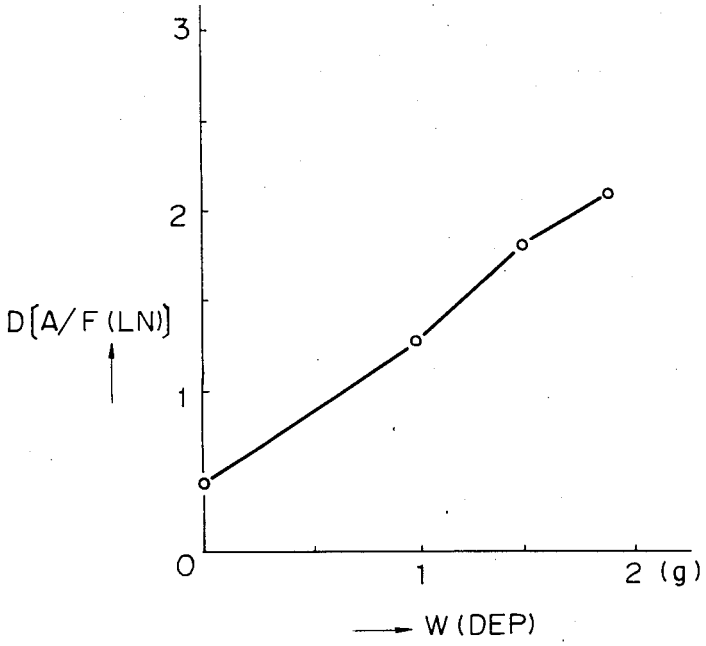
FIG. 5 is a diagram illustrating the relationship between the deposit amount in the air-intake passage and the air-fuel ratio deviation.

Further, as an example of air-fuel ratio deviation from the optimum air-fuel ratio, the relationships between the amount W(DEP) of deposits DEP in the air intake passage 2 (see FIG. 4) and the maximum air-fuel ratio deviations D[A/F(LN)]is illustrated in FIG. 5.

Thus, from FIGS. 3 and 5, the value W(DEP) corresponding to the deposit amount can be determined by measuring the lean-state duration T(LN) during acceleration and the engine speed $N_e$. The characteristics shown in FIGS. 3 and 5 are obtained by operating an engine of the 5M-G type manufactured by Toyota Jidosha K.K.

The operation of the control circuit 10 of FIG. 1 will be explained with reference to the flowcharts of FIGS. 6 through 12.

Figure 6:
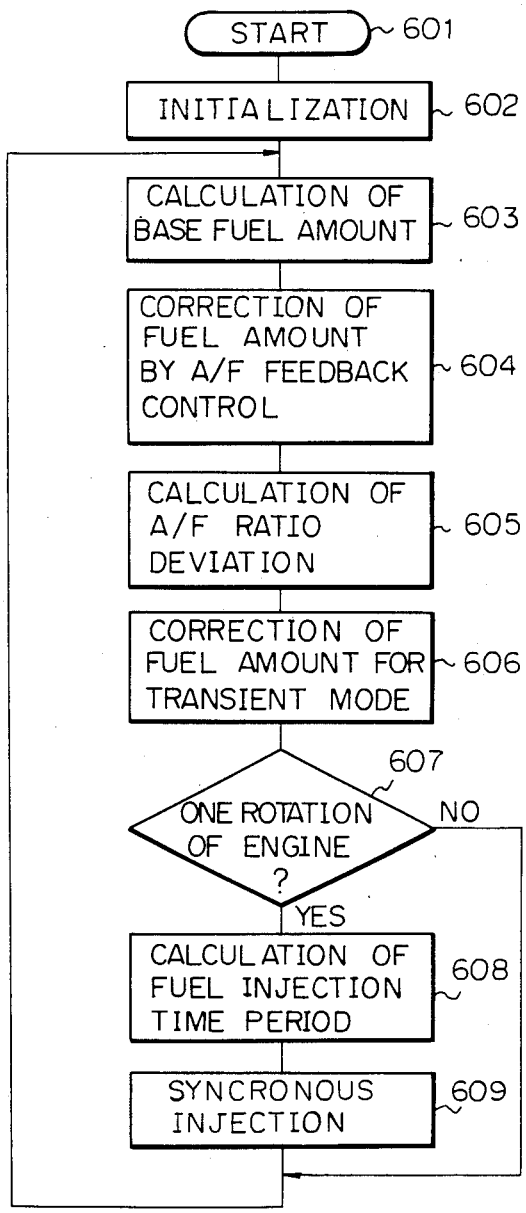

In FIG. 6, which is a main routine for carrying out electronically controlled fuel injection, the program enters into step 601 by turning on the ignition switch (not shown). At step 602, the memories, the input ports, the output ports, and the like are initialized. At step 603, a base fuel injection amount TAUP is calculated from data Q of the intake air amount and data $N_e$ of the engine speed. The amount TAUP is also determined by data THW of the coolant temperature. At step 604, the base fuel injection amount TAUP is corrected by feedback control using the signal from the $O_2$ sensor 15 to realize a constant air-fuel ratio. That is, the fuel injection amount TAU is calculated by TAU←TAUP×FAF where FAF is an air-fuel factor.

At step 605, the calculation of the air-fuel ratio deviation in the transient state is carried out. At step 606, the calculation of a transient fuel correction value is carried out. Note that the transient fuel correction amount can be also calculated by using the maximum deviation D[A/F(LN)]. At step 607, it is determined whether or not one rotation of the engine 1 is detected. As a result, at every one rotation of the engine 1, the program flow advances to step 608, in which the opening period of the fuel injection valve 9 for one injection is corrected by the transient fuel correction ratio. Then, at step 609, a synchronous fuel injection is carried out. Thus, the program flow returns to step 603. Also, if the determination at step 607 is negative, the program flow returns to step 603. Note that the synchronous injection step 609 is illustrated in detail in FIG. 8.

Figure 7A:
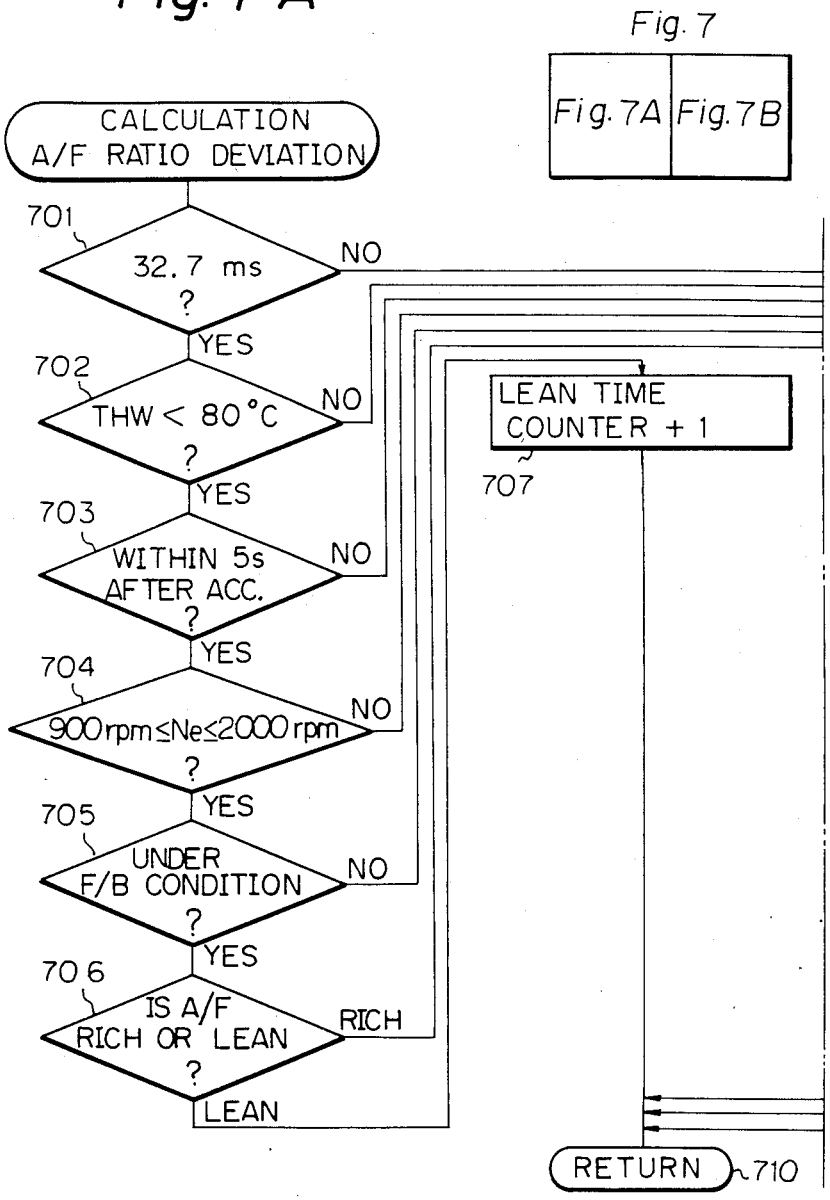
Figure 7B:
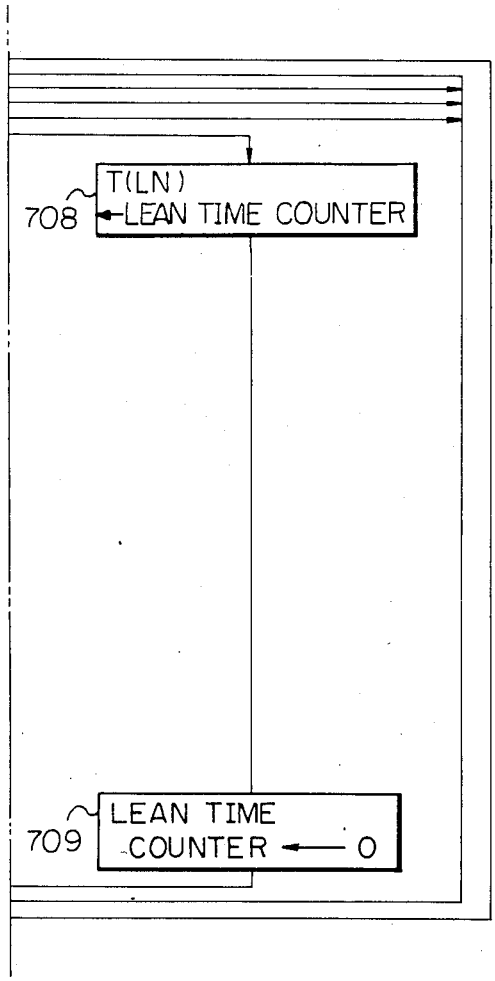

Referring to FIG. 7, which is a routine for calculating T(LN), at step 701, it is determined whether or not a predetermined time period such as 32.7 ms is elapsed. As a result, the subsequent steps after step 702 are carried out. To detect the air-fuel ratio deviation, the voltage of the output signal of the $O_2$ sensor 15 is compared with a definite voltage, the two values of the air-fuel ratio in a lean state and a rich state of the mixed gas are detected, and the lean-state duration T(LN) in the acceleration state is measured.

For example, the influence of deposits appears only when the coolant temperature THW is low. To facilitate the estimation of the amount of deposits at step 702, it is determined whether or not the coolant temperature is lower than a definite value such as 80° C. In addition, at step 703, it is determined whether or not a timing is within 5 seconds after acceleration, and at step 704, it is determined whether or not the rotational speed $N_e$ of the engine 1 is within a range of from 900 rpm to 2000 rpm. Further, at step 705, it is determined whether or not an air-fuel ratio feedback control operation is carried out. Only when all the determinations at steps 702, 703, 704, and 705 are affirmative, does the flow advance to step 706. At step 706, the determination of whether the air-fuel ratio is rich or lean is carried out. When lean, at step 707, the lean time counter is incremented by 1, thus counting T(LN) in units of 32.7 ms. Then, the routine of FIG. 7 is completed by step 710.

Contrary to the above, when rich at step 706, the program flow advances to step 708 in which T(LN)←LEAN TIME COUNTER, thus obtaining T(LN). Then at step 709, the lean time counter is cleared. Then, the program flow directly advances to step 710.

Figure 8:
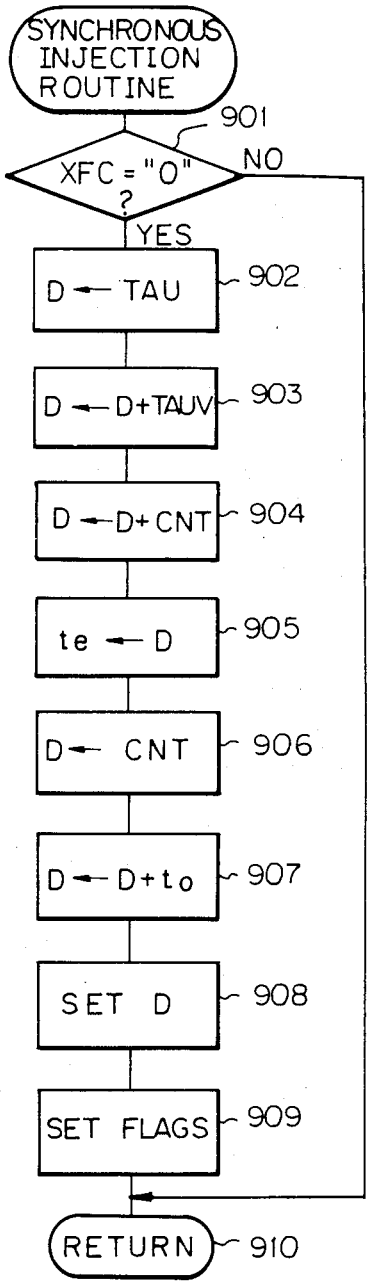

The synchronous fuel injection will be explained with reference to FIG. 8.

At step 901, it is determined whether or not a fuel cut-off flag XFC is "0". If XFC ="1", then the program proceeds directly to step 910, thus not carrying out a fuel injection. Otherwise, the program proceeds to step 902.

At step 902, the fuel injection time period TAU stored in the RAM 107 is read out and is transmitted to the D register (not shown) included in the CPU 104. At step 903, an invalid fuel injection time period TAUV, which is also stored in the RAM 107, is added to the content of the D register. In addition, at step 904, the current time CNT of the free-run counter of the timer counter 105 is read out and is added to the content of the D register, thereby obtaining an injection end time $t_e$ in the D register. Therefore, at step 905, the content of the D register is stored as the injection end time $t_e$ in the RAM 107.

Figure 9:
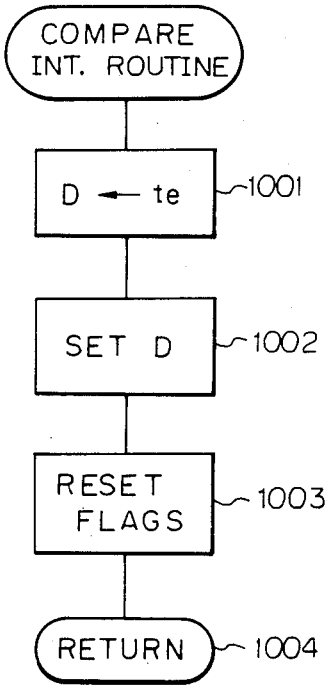

Again at step 906, the current time CNT of the free-run counter is read out and is set in the D register. Then, at step 907, a small time period $t_0$, which is definite or determined by the predetermined parameters, is added to the content of the D register. At step 908, the content of the D register is set in the compare register of the timer counter 105, and at step 909, a fuel injection execution flag and a compare interrupt permission flag are set in the registers of the timer counter 105. The routine of FIG. 9 is completed by step 910.

Thus, when the current time CNT of the free-run counter reaches the compare register, an injection-on signal due to the presence of the fuel injection execution flag is transmitted from the timer counter 105 via the I/O interface 102 to the driver circuit 103, thereby initiating fuel injection by the fuel injection valve 9. Simultaneously, a compare interrupt signal due to the presence of the compare interrupt permission flag is transmitted from the timer counter 105 to the CPU 104, thereby initiating a compare interrupt routine as illustrated in FIG. 9.

The completion of the fuel injection will be explained with reference to FIG. 9. At step 1001, the injection end time $t_e$ store in the RAM 107 is read out and is transmitted to the D register. At step 1002, the content of the D register is set in the compare register of the timer counter 105 and at step 1003, the fuel injection execution flag and the compare interrupt permission flag are reset. The routine of FIG. 9 is completed by step 1004.

Thus, when the current time CNT of the free-run counter reaches the compare register, an injection-off signal due to the absence of the fuel injection execution flag is transmitted from the timer counter 105 via the I/O interface 102 to the drive circuit 103, thereby ending the fuel injection by the fuel injection valve 9. In this case, however, no compare interrupt signal is generated due to the absence of the compare interrupt permission flag.

Thus, fuel injection of the fuel injection valve 9 is carried out for the time period TAU.

Figure 10:
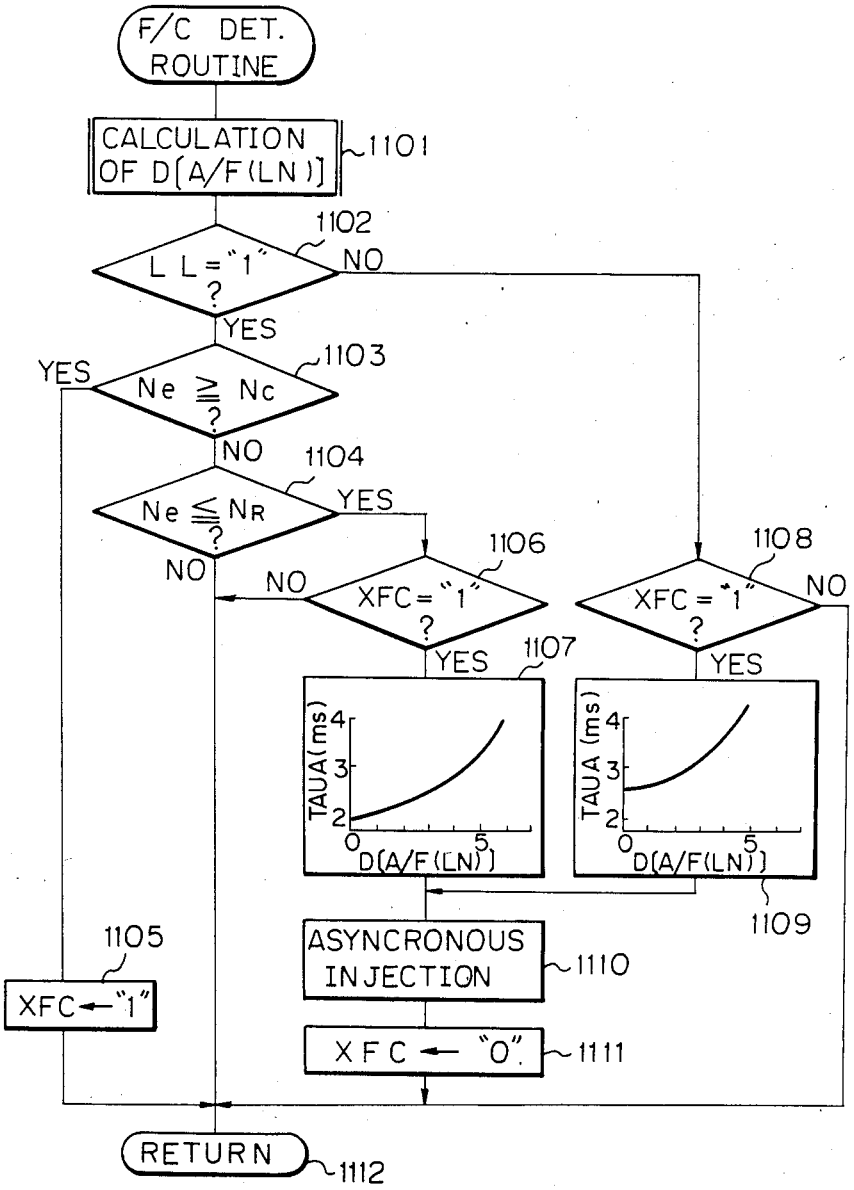

FIG. 10 is a routine for the determination of the fuel cut-off flag XFC executed at every predetermined time period or as one part of the main routine. That is, this routine is used for the determination of the flag XFC as shown in FIG. 8. In FIG. 10, $N_c$ designates a fuel cut-off engine speed, and $N_R$ designates a fuel cut-off recovery engine speed. All of the values $N_c$ and $N_R$ are dependent upon the engine coolant temperature THW.

At step 1101, the air-fuel ratio deviation D[A/F(LN)]corresponding to the deposit amount W(DEP) is calculated from a two-dimensional map stored in the ROM 106 by using the parameters T(LN) and $N_e$. That is, this map is prepared on the basis of the graph as illustrated in FIG. 3. In this case, the lean duration T(LN) is measured by the lean time counter of FIG. 7 as explained above. The calculated air-fuel ratio deviation D[A/F(LN)]is stored on the RAM 107.

As step 1102, it is determined whether or not the output signal LL of the idling position switch 5 is "1", i.e., whether or not the engine 1 is in an idling state. If in an idling state, at step 1103, the engine speed $N_e$ is read out of the RAM 107, and is compared with the fuel cut-off engine speed $N_c$, and at step 1104, the engine speed $N_e$ is compared with the fuel cut-off recovery engine speed $N_R$. As a result, if $N_e \geqq N_c$, the program proceeds to step 1105 which sets the flag XFC, i.e., XFC←"1", and if $N_e \leqq N_R$, the program advances to step 1106.

At step 1106, it is determined whether or not the flag XFC is "1". If XFC ="1", then this means that the engine is changed from a fuel cut-off state to a fuel cut-off recovery state. Therefore, at step 1107, an asynchronous fuel injection amount TAUA is calculated from a one-dimensional map stored in the ROM 106 by using the parameter D[A/F(LN)]as shown in the block of step 1107. Then, at step 1110, an asynchronous fuel injection for the calculated amount TAUA is carried out, and at step 1111, the flag XFC is cleared. Contrary to this, if XFC ="0" at step 1106, then the program advances directly to step 1112 thereby completing this routine.

Also, if $N_R < N_e < N_c$, the program proceeds directly to step 1112, so that the flag XFC is unchanged, and accordingly, remains at the previous state.

On the other hand, if LL ="0" at step 1102, the program proceeds to step 1108 which determines whether or not the flag XFC is "1". If XFC ="1", this means a first change from an idling state to a non-idling state. In this case, an acceleration state is detected by this step. Note that such a first change also means that the engine is changed from a fuel cut-off state to a fuel cut-off recovery state. Therefore, at step 1109, an asynchronous fuel injection amount TAUA is calculated from a one-dimensional map stored in the ROM 106 by using the parameter D[A/F(LN)]as shown in the block of step 1109. Then, the program advances via steps 1110 and 1111 to step 1112. Contrary to this, if XFC ="0"at step 1108, then the program advances directly to step 1112.

Note that the asynchronous fuel injection amount TAUA calculated at step 1109 is larger than that calculated at step 1107, thereby improving acceleration response characteristics.

Figure 11:
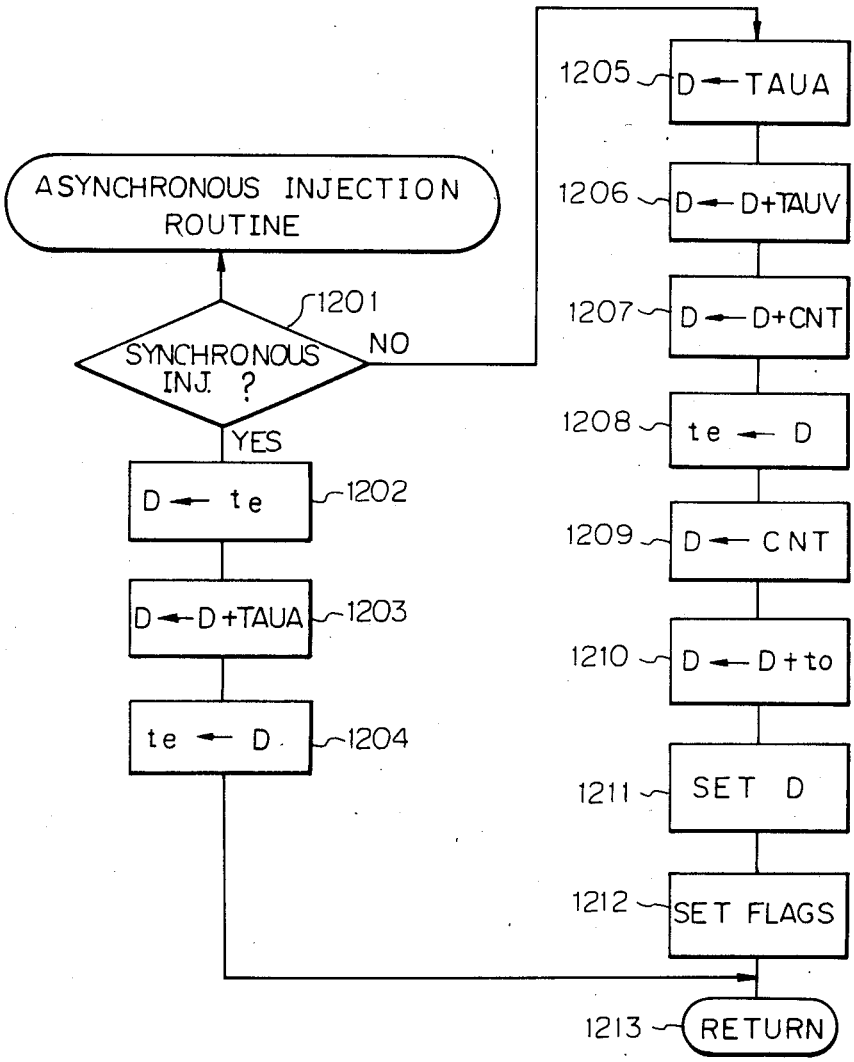

In FIG. 11, which is a detailed flow chart of step 1110 of FIG. 10, at step 1201, it is determined whether or not a synchronous injection executed by the routine of FIG. 6 is being carried out, i.e., whether the fuel injection execution flag of the timer counter 105 is set or reset. If the fuel injection execution flag is set, the program proceeds to steps 1202 through 1204 which prolong the fuel injection end time $t_e$. Contrary to this, if the fuel injection end execution flag is reset, the program proceeds to steps 1205 through 1212 which set the asynchronous fuel injection amount (time period) TAUA in the timer counter 105.

That is, at step 1202, the fuel injection end time $t_e$ is read from the RAM 107 to the D register, and at step 1203, the asynchronous injection time period TAUA is added to the content of the D register. Then, at step 1204, the content of the D register is stored in the RAM 107. Thus, the fuel injection end time $t_e$ is prolonged by the asynchronous injection time period TAUA.

On the other hand, the asynchronous injection time period TAUA is transmitted to the D register. After that, the program goes to steps 1206 through 1212, which are the same as steps 903 through 909 of FIG. 8, respectively. Thus, in this case, fuel injection of the fuel injection valve 9 is carried out for the time period TAUA.

The routine of FIG. 11 is completed by step 1213.

As explained above, according to the present invention, since an asynchronous fuel injection, the amount of which corresponds to the air-fuel ratio deviation D[A/F(LN)], i.e., the deposit amount W(DEP), is carried out at a transition from a fuel cut-off state to a fuel cut-off recovery state, reduction of the engine speed can be suppressed, thereby avoiding a rough idling phenomenon, engine stalling, or the like.

I claim:

1. A method for controlling the air-fuel ratio in an internal combustion engine comprising the steps of:

calculating a base fuel amount in accordance with predetermined engine operating parameters;

determining whether or not said engine is in an acceleration state;

calculating an air-fuel ratio deviation from the optimum air-fuel ratio when said engine is in an acceleration state;

calculating a synchronous fuel amount in accordance with said base fuel amount;

determining whether said engine is in a fuel cut-off state or in a fuel cut-off recovery state;

causing said synchronous fuel amount to be zero when said engine is in a fuel cut-off state;

calculating an asynchronous fuel amount in accordance with said calculated air-fuel ratio deviation when said engine is changed from a fuel cut-off state to a fuel cut-off recovery state; and adjusting the air-fuel ratio of said engine in accordance with said calculated synchronous and asynchronous fuel amounts.

2. A method as set forth in claim 1, wherein said predetermined engine operating parameters are the intake air amount and the rotational speed of said engine.

3. A method as set forth in claim 1, wherein said predetermined engine operating parameters are the intake air pressure and the rotational speed of said engine.

4. A method as set forth in claim 1, wherein said acceleration state determining step comprises the steps of:

determining whether or not the engine coolant temperature is lower than a predetermined value;

determining whether or not a predetermined time period has passed after an acceleration state;

determining whether or not the rotational speed of said engine is within a predetermined range; and determining whether or not an air-fuel ratio feedback control operation is carried out, whereby said acceleration state is established only when all said determinations are affirmative.

5. A method as set forth in claim 1, wherein said fuel cut-off step comprises to steps of:

determining whether or not a throttle valve of said engine is completely closed;

determining whether or not a fuel cut-off operation is performed upon said engine;

comparing the current engine speed with a predetermined fuel cut-off engine speed, when said throttle valve is completely closed and the fuel cut-off operation is not carried out;

comparing the current engine speed with a predetermined fuel cut-off recovery engine speed, when said throttle valve is completely closed and the fuel cut-off operation is carried out;

setting said engine in a fuel cut-off state when said throttle valve is completely closed, and it is determined that the current engine speed is higher than said predetermined fuel cut-off engine speed or said predetermined fuel cut-off recovery engine speed; and setting said engine in a fuel cut-off recovery state when said throttle valve is not completely closed, or when said throttle valve is completely closed and it is determined that the current engine speed is lower than said predetermined fuel cut-off engine speed or said predetermined fuel cut-off recovery engine speed.

6. A method as set forth in claim 5, wherein said asynchronous fuel amount calculated at the transition from said fuel cut-off state to said fuel cut-off recovery state due to the transition of the opening of said throttle valve is larger than said asynchronous fuel amount calculated at the transition from said fuel cut-off state to said fuel cut-off recovery due to the transition of the current engine speed.

7. An apparatus for controlling the air-fuel ratio in an internal combustion engine comprising:

means for calculating a base fuel amount in accordance with predetermined engine operating parameters;

means for determining whether or not said engine is in an acceleration state;

means for calculating an air-fuel ratio deviation from the optimum air-fuel ratio when said engine is in an acceleration state;

means for calculating a synchronous fuel amount in accordance with said base fuel amount;

means for determining whether said engine is in a fuel cut-off state or in a fuel cut-off recovery state;

means for causing said synchronous fuel amount to be zero when said engine is in a fuel cut-off state;

means for calculating an asynchronous fuel amount in accordance with said calculated air-fuel ratio deviation when said engine is changed from a fuel cut-off state to a fuel cut-off recovery state; and means for adjusting the air-fuel ratio of said engine in accordance with said calculated synchronous and asynchronous fuel amounts.

8. An apparatus as set forth in claim 7, wherein said predetermined engine operating parameters are the intake air amount and the rotational speed of said engine.

9. An apparatus as set forth in claim 7, wherein said predetermined engine operating parameters are the intake air pressure and the rotational speed of said engine.

10. An apparatus as set forth in claim 7, wherein said acceleration state determining means comprises:

means for determining whether or not the engine coolant temperature is lower than a predetermined value;

means for determining whether or not a predetermined time period has passed after an acceleration state;

means for determining whether or not the rotational speed of said engine is within a predetermined range; and means for determining whether or not an air-fuel ratio feedback control operation is carried out, whereby said acceleration state is established only when all said determinations are affirmative.

11. An apparatus as set forth in claim 7, wherein said fuel cut-off means comprises:

means for determining whether or not a throttle valve of said engine is completely closed;

means for determining whether or not a fuel cut-off operation is performed upon said engine;

means for comparing the current engine speed with a predetermined fuel cut-off engine speed, when said throttle valve is completely closed and the fuel cut-off operation is not carried out;

means for comparing the current engine speed with a predetermined fuel cut-off recovery engine speed, when said throttle valve is completely closed and the fuel cut-off operation is carried out;

means for setting said engine in a fuel cut-off state when said throttle valve is completely closed, and it is determined that the current engine speed is higher than said predetermined fuel cut-off engine speed or said predetermined fuel cut-off recovery engine speed; and means for setting said engine in a fuel cut-off recovery state when said throttle valve is not completely closed, for when said throttle valve is completely closed and it is determined that the current engine speed is lower than said predetermined fuel cut-off engine speed or said predetermined fuel cut-off recovery engine speed.

12. An apparatus as set forth in claim 11, wherein said asynchronous fuel amount calculated at the transition from said fuel cut-off state to said fuel cut-off recovery state due to the transition of the opening of said throttle valve is larger than said asynchronous fuel amount calculated at the transition from said fuel cut-off state to said fuel cut-off recovery due to the transition of the current engine speed.

* * * * *